United States Patent [19]

Martin

[11] Patent Number: 4,728,756

[45] Date of Patent: Mar. 1, 1988

[54] KEY SWITCH HAVING PIVOTABLE HOUSING MEMBERS AND CONTACT POSITIONING POSTS

[75] Inventor: Adolf H. Martin, Glenview, Ill.

[73] Assignee: Adams Elevator Equipment Company, Skokie, Ill.

[21] Appl. No.: 857,679

[22] Filed: Apr. 30, 1986

[51] Int. Cl.[4] ..... H01H 27/06; H01H 9/02

[52] U.S. Cl. ..... 200/43.08; 200/153 LB; 200/250; 200/303

[58] Field of Search ..... 200/43.08, 43.06, 336, 200/250, 245, 153 LB, 303, 6 BB, 241, 242; 70/239, 251, DIG. 30

[56] References Cited

U.S. PATENT DOCUMENTS

| | | | |
|---|---|---|---|
| 2,803,716 | 8/1957 | Nolden et al. | 200/43.08 |
| 3,310,642 | 3/1967 | Zeller | 200/43.08 |
| 3,319,022 | 5/1967 | Froyd et al. | 200/241 |
| 3,911,761 | 10/1975 | Cornellier | 200/153 LB |
| 4,059,738 | 11/1977 | Mongeau | 200/153 LB |
| 4,071,720 | 1/1978 | Krajci et al. | 200/6 BB |
| 4,493,953 | 1/1985 | Bound | 200/153 LB |

FOREIGN PATENT DOCUMENTS

| | | | |
|---|---|---|---|
| 162926 | 6/1952 | Australia | 200/153 LB |
| 1198397 | 7/1958 | France | 200/43.08 |

*Primary Examiner*—Henry J. Recla
*Assistant Examiner*—Renee S. Luebke
*Attorney, Agent, or Firm*—D. R. Lackey

[57] ABSTRACT

A multiple position, multiple contact key switch, and method of constructing same, including an electrical contact module having a housing defined by first and second separable housing members which snap together in a direction perpendicular to the longitudinal rotational axis of the key switch. The first and second housing members each carry contact sets which alternate with one another along the longitudinal axis. Each housing member includes posts which extend towards the opposing housing member, to maintain the desired positions of the elements of the contact sets carried by the opposing housing member. An arbor is mounted for rotation within the housing, with the arbor having cams spaced along the rotational axis for actuating the contact sets. A halo module and a lock module form a subassembly which is coupled with the electrical contact module, with adjacent ends of the lock module and electrical contact module engaging to transmit rotary motion of the lock module to rotary motion of the arbor.

6 Claims, 33 Drawing Figures

KEY SWITCH HAVING PIVOTABLE HOUSING MEMBERS AND CONTACT POSITIONING POSTS

BACKGROUND OF THE INVENTION

1. Field of the Invention:

The invention relates in general to electrical switches, and more specifically to key operated electrical switches.

2. Description of the Prior Art:

There are many applications for key operated electrical switches which require a plurality of contacts, and there are many applications for key operated switches which require more than two switch positions for each contact. It would be desirable to provide a new and improved key operated electrical switch which may be quickly and easily manufactured to specified numbers of contacts and contact positions, using modular components which permit different lock modules, halo modules, and electrical contact modules to be assembled to suit each specific application.

SUMMARY OF THE INVENTION

Briefly, the present invention is a new and improved multi-contact, multi-position key switch of modular construction which utilizes only three basic modules, i.e., an electrical contact module, a lock module, and a halo module. The halo module includes a key switch halo adapter or switch cover, which is adapted to receive a snap-in halo of any desired color, and any desired configuration, e.g., round, square, etc. The snap-in halo may include legends for indentifying the positions of the key switch.

The lock module, which may be any commercially available rotatable type lock assembly, is mounted in the key switch halo adapter of the halo module to provide a subassembly which is coupled with the electrical contact module. The various modules are all held in assembled relation by a pair of studs which extend outwardly from the back side of a panel which the key switch is to be associated with.

The electrical contact module includes first and second housing members which are assembled to cooperatively define a housing having internal and external sides. Each of the first and second housing members includes similar contact sets. The first and second housing members are constructed such that the elements of the contact sets are inserted through openings in a wall portion, from an internal side thereof, until they reach a stop pad. When the first and second housing members are assembled, which action occurs in a direction perpendicular to the longitudinal rotational axis of the key switch, projections or posts on the internal sides of the wall portions which carry the contact sets extend towards the contact elements of the opposing housing member, to physically hold the contact elements in position against their associated stop pads. Each contact set includes a helical spring which biases a movable contact element having a leaf spring against a stationary contact. The spring values of the helical and leaf springs are selected such that actuation of the leaf spring by a cam causes a contact wiping action to occur, both upon making and breaking electrical contact.

An arbor is mounted for rotation within the housing of the electrical contact module, with a cam being telescoped onto the arbor for each electrical contact set. Each cam has lobes selected to actuate the associated contact set by contacting the leaf spring element of the set, to overcome the bias of the helical spring and open the normally-closed contacts of this set.

A stop washer on the lock module selects the desired number of switch positions, which in a preferred embodiment is a maximum of four. Each cam has a cam lobe arrangement selected to provide an open or closed contact configuration at each position of the key switch.

Screw terminal portions of the contact elements are disposed adjacent to external sides of the contact housing. The screw terminal portions each include a planar surface for receiving an electrical wire, with these planar surfaces being oriented 45° to the longitudinal rotational axis of the key switch, in order to provide easy access to the screw terminals from the rear of each switch. Insulative barrier members extend outwardly from the first and second housing members between adjacent screw terminals of different contact sets, with the barrier members having planar surfaces which are oriented perpendicular to the planar surfaces of the associated screw terminals, to reduce the possibility of shorting adjacent screw terminals with a screwdriver.

The arbor has teeth at one axial end which engage complementary teeth on a cam adapter drive gear which is fixed to an axial end of the lock module. Rotation of the lock core of the lock module thus rotates the arbor and its associated cams to actuate the contact sets of the key switch at the prescribed switch positions.

BRIEF DESCRIPTION OF THE DRAWINGS

The invention may be better understood, and further advantages and uses thereof more readily apparent, when considered in view of the following detailed description of exemplary embodiments, taken with the accompany drawings in which.

DESCRIPTION OF PREFERRED EMBODIMENTS

Figure 1:
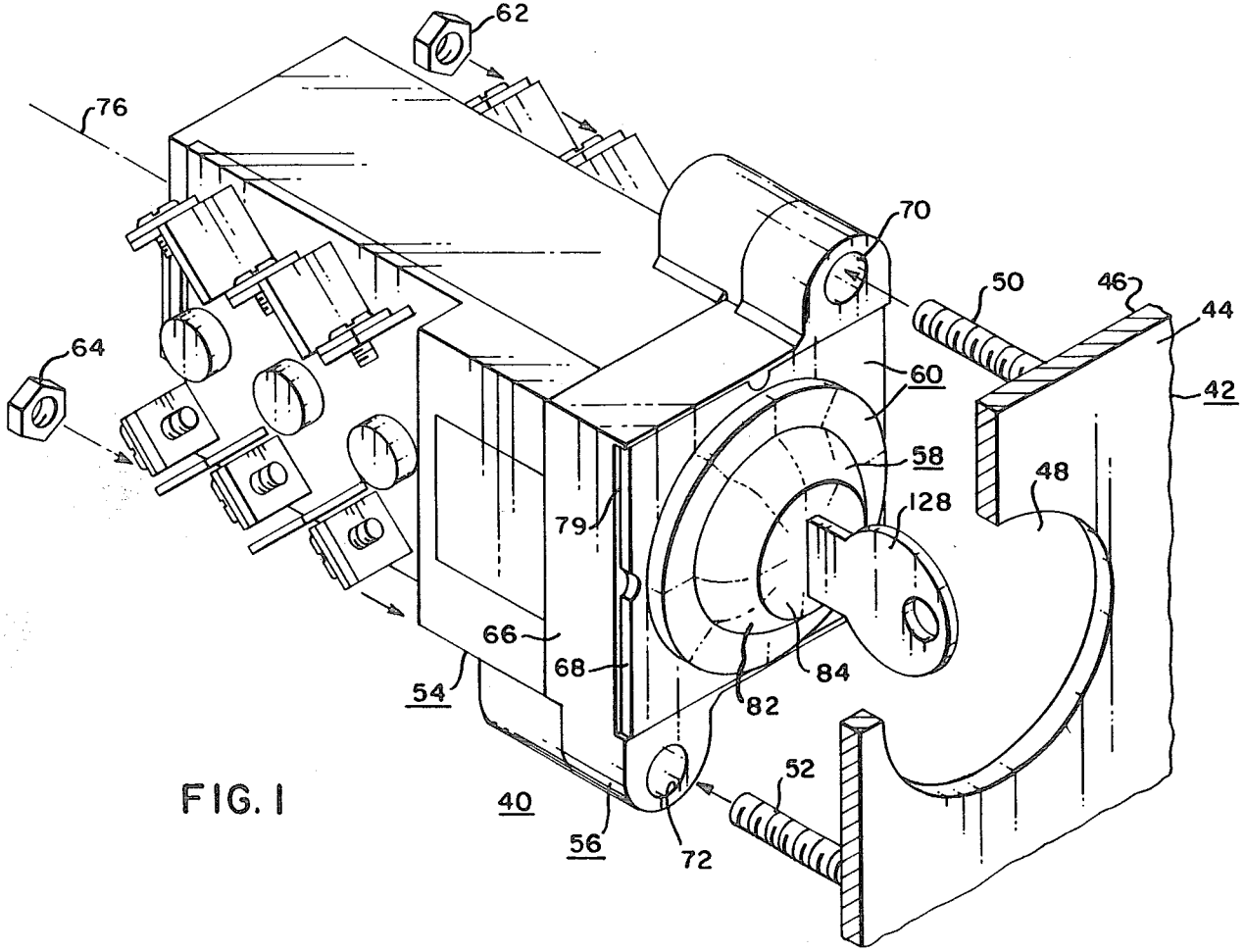
FIG. 1 is a perspective view of a multi-contact, multi-position key switch having halo, lock and contact modules constructed according to the teachings of the invention.
Figure 2:
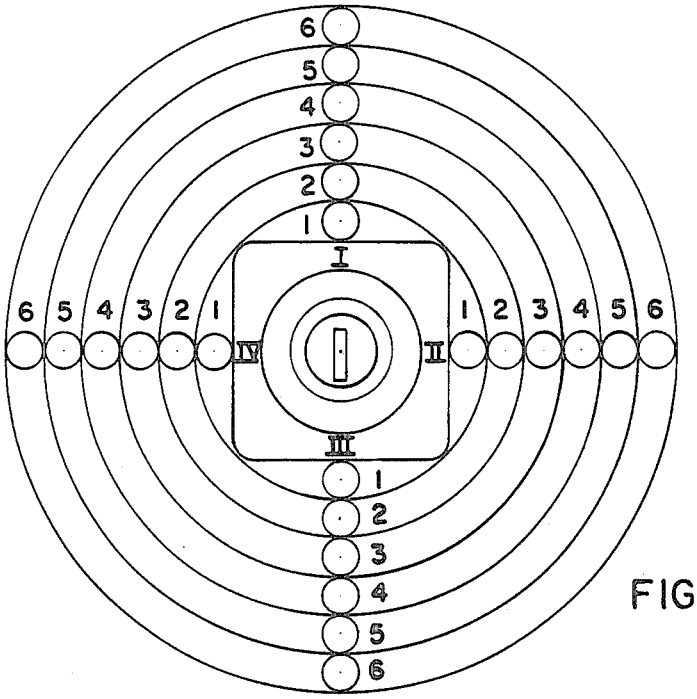
FIG. 2 diagrammatically illustrates the large number of switch contact possibilities in a preferred embodiment of the invention.

Referring now to the drawings, and to FIG. 1 in particular, there is shown a perspective view of a multi-contact, multi-position key switch 40 constructed according to the teachings of the invention. For purposes of example, key switch 40 is constructed to have a maximum of six contact sets, and a maximum of four switch positions. Each of the six contacts may be open or closed in any combination in each of the four different switch positions. FIG. 2 diagrammatically illustrates the large number of contact possibilities. FIG. 2, for example, may be used as a convenient way for a prospective user to order the key switch tailored to the requirements of a specific application. For example, the circles may be blackened for a closed contact position, and they may be left unmodified for an open contact position.

Returning now to FIG. 1, key switch 40 is adapted for mounting in a panel 42 having front and rear sides or surfaces 44 and 46, respectively, an opening 48 which extends between sides 44 and 46, and first and second stud members 50 and 52 which are fixed to and which extend perpendicularly outward from, the rear side 46 of panel 42.

Figure 3:
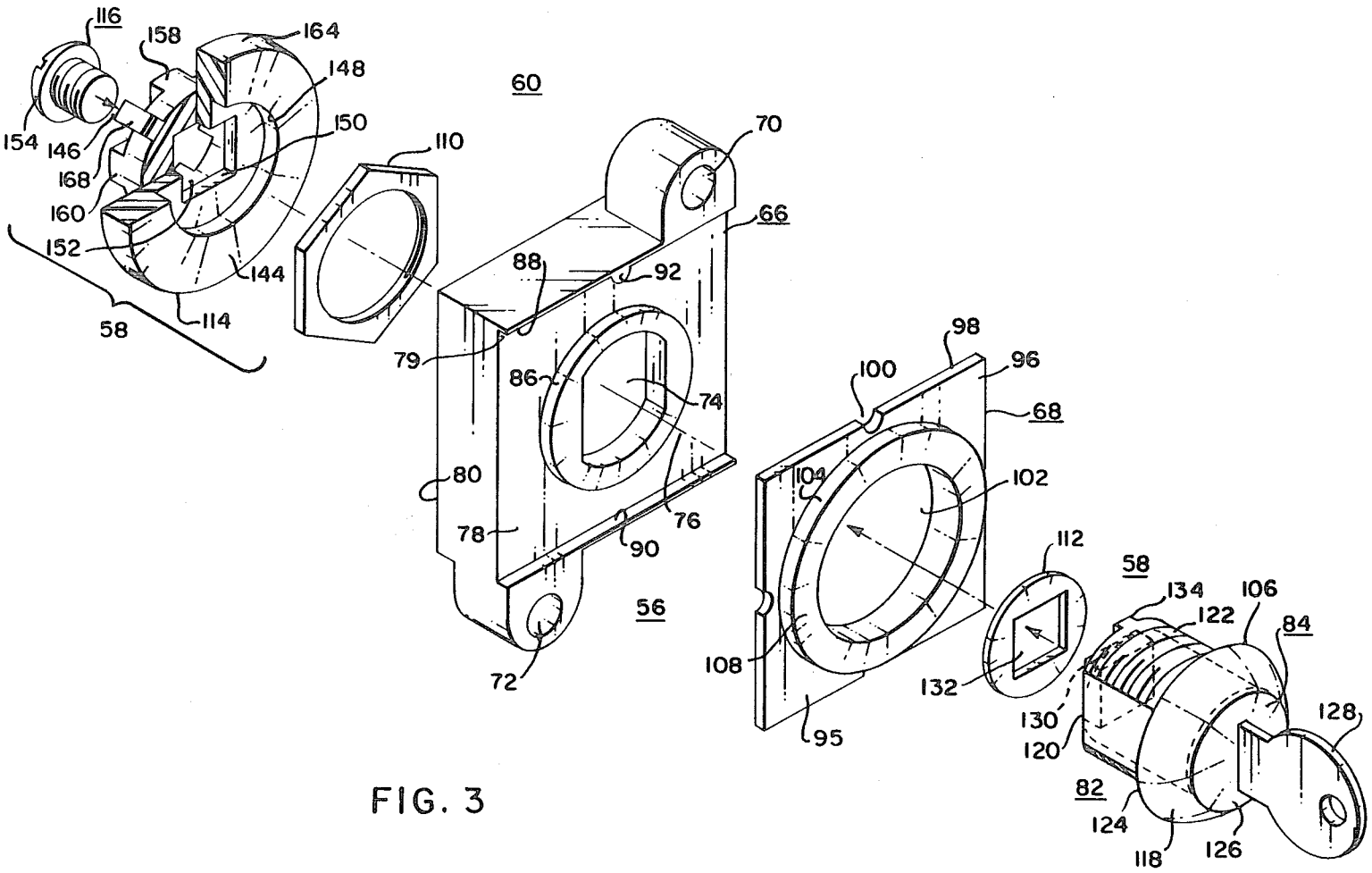
FIG. 3 is an exploded perspective view of the lock and halo modules shown in FIG. 1.
Figure 9:
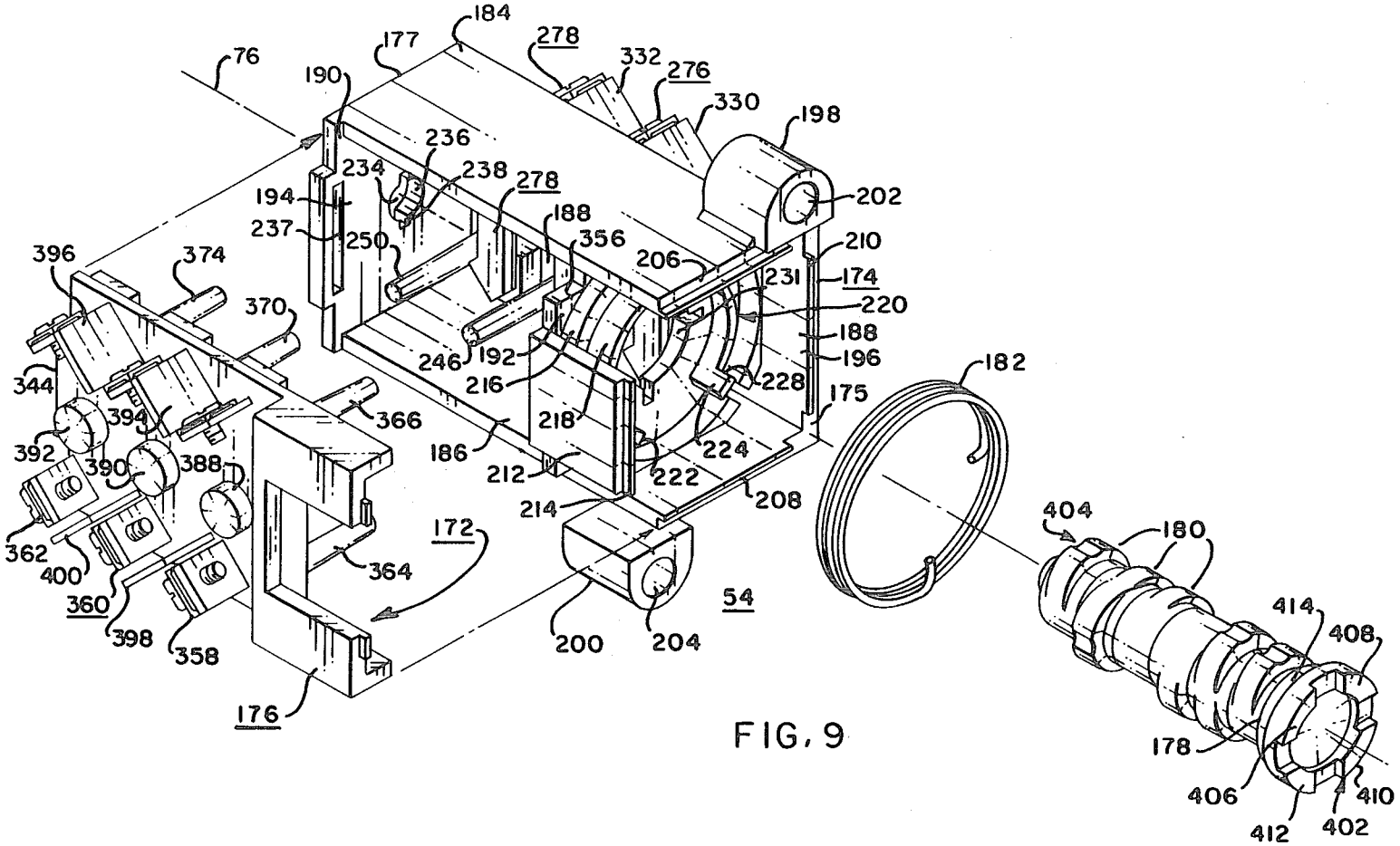
FIG. 9 is an exploded perspective view of the electrical contact module shown in FIG. 1.

Key switch 40 is of modular construction, including an electrical contact module 54, a halo module 56, and a lock module 58. Lock module 58 is assembled with halo module 56 to provide a subassembly 60 which is held in assembled relation with the electrical contact module 54 by studs 50 and 52 and nuts 62 and 64. FIGS. 3 and 9 are exploded, perspective views of key switch 40, which more clearly illustrate the various elements of the three modules. FIG. 3 illustrates the halo and lock modules 56 and 58, respectively, while FIG. 9 illustrates the electrical contact module 54.

More specifically, FIG. 3 is an exploded, perspective view of subassembly 60 which includes the halo and lock modules 56 and 58, respectively. The halo module 56, shown in FIGS. 1 and 3, includes a key switch halo adapter 66 which functions as a cover for the electrical contact module 54, and a halo 68. The key switch halo adapter 66 is preferably dimensionally similar to the halo shown in U.S. Pat. No. 4,504,713, which patent is assigned to the same assignee as the present application, and to the halo shown in my co-pending application Ser. No. 857,678, filed concurrently herewith, entitled "Key Switch". This dimensional similarity will facilitate mounting the key switch of the present application in panels along with the pushbutton electrical switch assembly disclosed in the aforesaid U.S. Pat. No. 4,504,713, and the two-position key switch disclosed in my co-pending application.

Halo adapter 66 includes stud receiving openings 70 and 72, which are respectively aligned with stud receiving openings in the electrical contact module 54, when subassembly 60 is assembled with the electrical contact module 54. Halo adapter 66 also includes a central, longitudinally extending opening 74 coaxial with a longitudinal centerline 76. Centerline 76 coincides with the longitudinal centerline and rotational axis of key switch 40. Centerline 76 extends between first and second axial ends 78 and 80 of the halo adapter 66. Opening 74 is configured to snugly receive the lock module 58, and to prevent the stationary portion or lock case 82 of the lock module 58 from rotating, when the rotatable portion or lock core 84 is rotated about longitudinal axis 76.

The first axial end 78 of halo adapter 66 is recessed slightly to provide a recess 79, which recess is defined by a round protuberance 86 about opening 74, and by upper and lower flanges 88 and 90, respectively. A centrally disposed locating key 92 extends into recess 79 from flange 88. Halo adapter 66 is preferably formed of a mechanically strong plastic, such as a polycarbonate.

Halo module 56 further includes halo 68, which may also be formed of a polycarbonate, or other materials, such as anodized aluminum. Halo 68 includes a thin plate-like section 95 having first and second major sides or surfaces 96 and 98, respectively. The thickness dimension of the thin plate-like section 95, between its major surface 96 and 98, is selected to be substantially equal to the depth of the flanges 88 and 90 which define the recess 79 in the halo adapter 66. Thin plate-like section 95 has a square outer configuration dimensioned to provide a slight interference fit between flanges 88 and 90 of the halo adapter 66, with each side of the square configuration having a centrally located depression, such as depression 100. Halo 68 includes a central opening 102 defined by a cylindrical, tubular projection 104 which extends outwardly from major side 96 of thin plate-like section 95. The diameter of opening 102 is selected to accept the larger end portion 106 of the lock case 82, and the outside diameter and length of the cylindrical projection 104 are selected to cause the cylindrical projection to snugly extend into opening 48 of panel 42, and to either smoothly continue the flat front surface 44 of panel 42 or to extend beyond it. The outermost end 108 of projection 104, which is aligned with surface 44 of panel 42, may also have legands inscribed thereon to indicate the locations of the positions of the key switch 40, such as the legends I, II, III and IV, for a four-position key switch. Halo 68, being a slight interference fit between flanges 88 and 90 of the halo adapter 66, easily snaps into the recess 79, accurately centered by positioning key 92 and the depression or groove 100. Halo 68 may be provided in different colors, different configurations, and with different legends, to make key switch 40 adaptable to virtually any application.

The lock module 58 may utilize any one of a wide variety of locks which are actuated by a key and rotary motion. The lock module 58 shown in FIG. 3 is typical, having a stationary lock case 82 and a rotatable lock core 84. The lock module 58 further includes a nut 110, a stop washer 112, a cam drive gear member 114, and a screw 116. The lock case 82 has first and second axial ends 118 and 120, the hereinbefore mentioned larger end portion 106, which is at the first axial end 118, and a threaded shank portion 122 which extends from the enlarged portion 106 to the second axial end 120.

In forming the subassembly 60, the threaded shank 122 of the lock case 82 is disposed through opening 74 of the halo adapter 66, with a flange 124, created at the interface between shank 122 and head 66 of the lock case 82, disposed against protuberance 86. Nut 110 is then threadably engaged with shank 122, to secure the lock case 82 in the halo adapter 66.

The rotatable lock core 84 has a first axial end 126 which receives an operating key 128, and a second axial end 130. The second axial end 130 has a square cross-sectional configuration, and a tapped, centrally disposed opening which extends inwardly from the second axial end 130. The stop washer 112 has an opening 132 sized to be snugly pressed over the square second axial end 130 of the lock core 84, until it rests against the second axial end 120 of the lock case 82. In the embodiment of FIG. 3, the complete outer periphery of stop washer 112 is recessed to avoid an extension 134 located at the second axial end 120 of the lock case 82, to allow complete 360°-degree rotational movement of the lock case 82, which is required for a four-position key switch.

Figure 4:
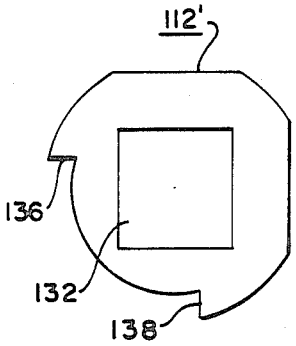
FIG. 4 illustrates an alternative stop washer which may be used in place of the stop washer shown in FIG. 3.
Figure 5:
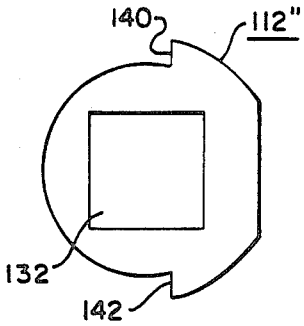
FIG. 5 illustrates still another stop washer which may be used instead of the stop washer shown in FIG. 3.

FIGS. 4 and 5 illustrate stop washers 112′ and 112″, which may respectively be used for two- and three-position key switches. Stop washer 112′ shown in FIG. 4 has its outer periphery recessed to avoid extension 134 for 90 degrees, to allow the lock core 84 to rotate between two switch positions, the limits of which are defined by stops 136 and 138. In like manner, stop washer 112″ shown in FIG. 5 has its outer periphery recessed to avoid extension 134 for 180 degrees, to allow lock core 84 to rotate between three switch positions, the limits of which are defined by stops 140 and 142.

Figure 6:
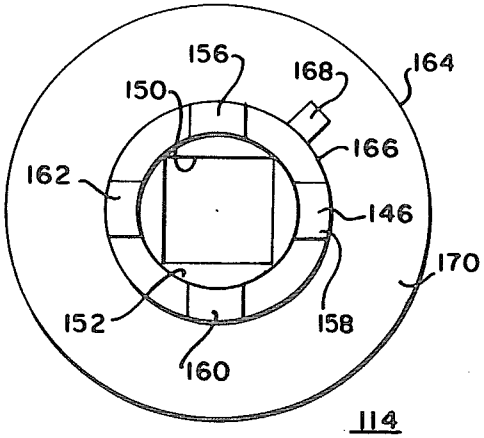
FIG. 6 is an end elevational view of a cam drive gear member shown in FIG. 3, illustrating the toothed drive end which engages the electrical contact module.
Figure 8:
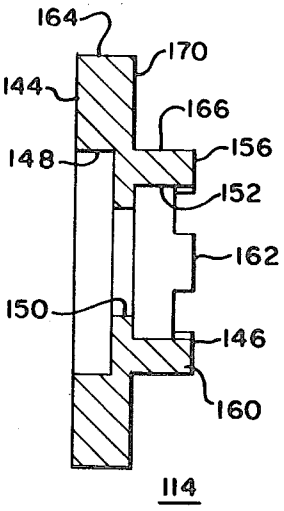
FIG. 8 is a cross-sectional view of the cam drive gear member shown in FIG. 6, taken between and in the direction of arrows VIII—VIII.
Figure 7:
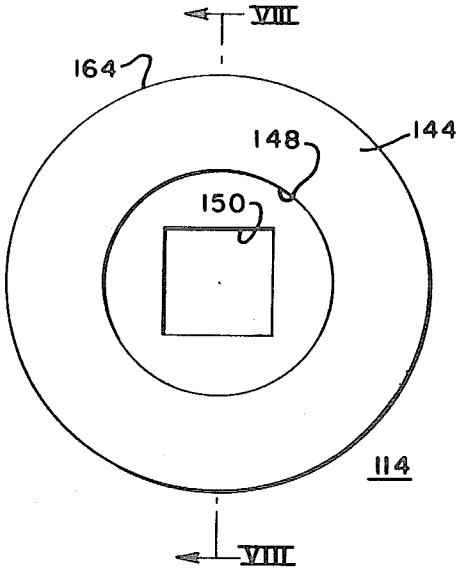
FIG. 7 is an elevational end view of the cam drive gear member shown in FIG. 6, illustrating the end which is fixed to the lock module.

The cam drive gear member 114 shown in perspective in FIG. 3, is shown in end views in FIGS. 6 and 7, and in a cross-sectional view in FIG. 8. The cross-sectional view of FIG. 8 is taken between and in the direction of arrows VIII—VIII in FIG. 6. Cam drive gear member 114 has first and second axial ends 144 and 146, respectively, and a stepped opening which extends between its ends, including a round opening 148 which starts at the first axial end 144. Round opening 148 is sized to receive the second axial end 120 of the lock case 84. The stepped opening through cam drive gear member 114 continues with a square opening 150 sized to receive the square cross-sectional configuration of the second axial end 130 of the lock core 84. The stepped opening then continues with a round opening 152 sized to snugly receive the diameter of the head portion 154 of screw 116.

Cam drive gear member 114 has a round, relatively large diameter which starts at the first axial end 144, defined by surface 164, and it extends towards the second axial end 146 for a dimension which is about equal to the combined lengths of the internal openings 148 and 150. The outer surface then steps sharply inward to a smaller diameter defined by surface 166. Surface 166 extends to the second axial end 146, and is smooth except for a driving key 168 which extends outwardly from surface 166 along a flange 170 created at the interface between surfaces 164 and 166. The driving key extends radially outward for a distance equal to about half the dimension between surfaces 164 and 166. Driving key 168 is used to cooperate with a torsion spring in momentary contact embodiments of the invention, as will be hereinafter explained. The second axial end 146 of cam drive gear member 114 has a plurality of circumferentially spaced, axially extending teeth, such as four teeth referenced 156, 158, 160 and 162. The function of teeth 156, 158, 160 and 162 will be hereinafter explained.

FIG. 9 is an exploded, perspective view of the electrical contact module 54 shown in FIG. 1. Electrical contact module 54 includes a housing 172 cooperatively formed of a housing base 174 having first and second axial ends 175 and 177, and a housing lid 176. Electrical contact module 54 further includes a cam adapter shaft or arbor 178, which has a plurality of cams, referenced generally with reference numeral 180, mounted thereon. In momentary contact embodiments of the key switch 40, the electrical contact module 54 also includes a torsion spring 182.

Figure 11:
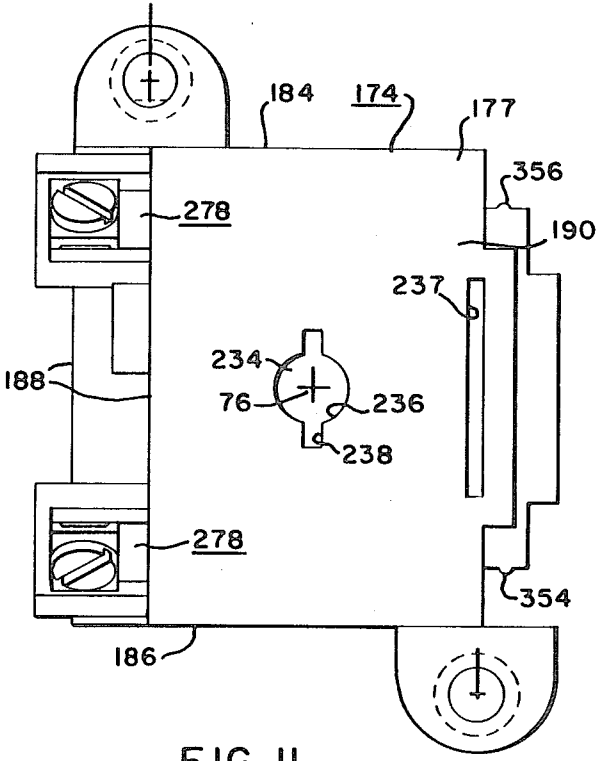
FIG. 11 is an elevational end view of the housing base shown in FIGS. 1 and 10, illustrating the back side of the housing base.
Figure 10:
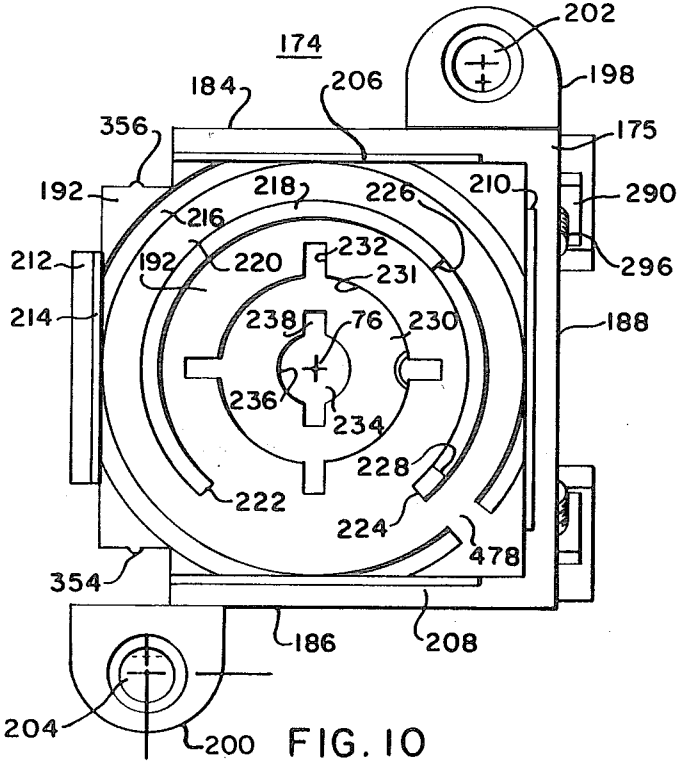
FIG. 10 is an elevational end view of a housing base portion of the contact housing shown in FIG. 9, illustrating the end which is closed by the lock and halo module subassembly.
Figure 12:
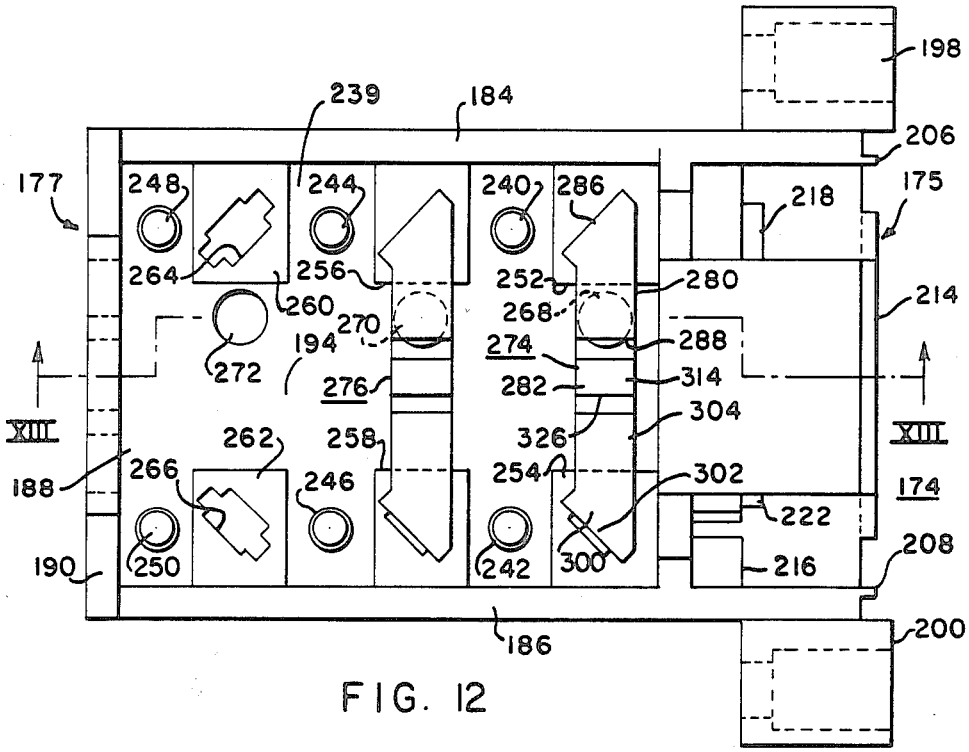
FIG. 12 is a view of the inside of the housing base shown in FIGS. 10 and 11, illustrating two of three possible contact sets.
Figure 13:
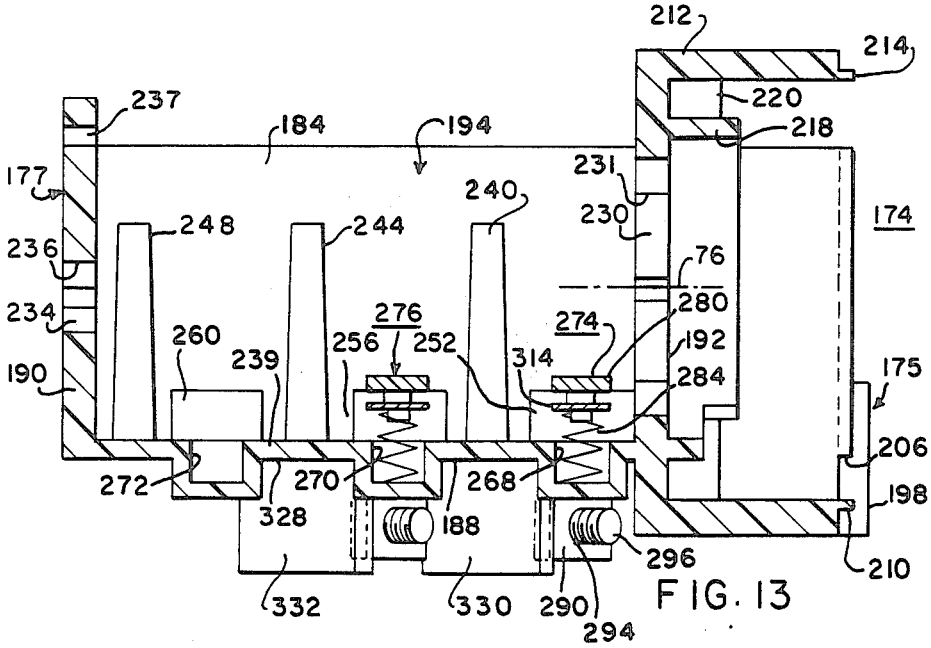
FIG. 13 is a cross-sectional view of the housing base shown in FIG. 12, taken between and in the direction of arrows XIII—XIII.

In describing the housing base 174, FIGS. 10 through 13 will also be referred to. With reference to the perspective view of the housing base 174 shown in FIG. 9, FIG. 10 is an elevational view of the first axial end 175, and FIG. 11 is an elevational view of the second axial end 177. FIG. 12 is an elevational view of the side of the housing base 174 which receives the housing lid 176, and FIG. 13 is a cross-sectional view of the housing base, taken between and in the direction of arrows XIII--XIII in FIG. 12.

More specifically, housing base 174 includes a high strength plastic supporting structure, such as a structure formed of a polycarbonate, with the plastic structure including a top portion 184, a bottom portion 186, a right hand side portion 188, referenced relative to the perspective view of FIG. 9, a back portion 190 at the second axial end 177, and a transverse wall portion 192 disposed between the axial ends, but relatively closer to the first axial end 175 than to the second axial end 177. The left hand side is largely open, providing access to an enclosure or compartment 194 for housing the electrical contact sets, which enclosure is defined by top 184, bottom 186, right hand side 188, back 190 and wall 192. Wall 192 also aids in defining a compartment 196 for receiving the torsion spring 182, in momentary contact embodiments of the invention, and the cam drive gear member 114 of subassembly 60.

The top and bottom portions 184 and 186 include outwardly extending projections 198 and 200, respectively, which have openings 202 and 204 which are aligned with openings 70 and 72, respectively, of halo adapter 66, for receiving studs 50 and 52. The top, bottom and right hand side portions 184, 186 and 188, respectively, include axially extending flange-like extensions 206, 208 and 210 which snugly extend into the halo adapter 66 for positioning and alignment purposes. Transverse wall portion 192 may include a small mini-wall portion 212 which extends to the first axial end 175, with the wall portion 212 having an axially extending flange 214 similar in construction and function to flanges 206, 208 and 210.

Transverse wall portion 192 further includes curved, radially spaced, axially extending portions 216 and 218 which define a recess 220 therebetween for receiving torsion spring 182 in momentary contact embodiments of the invention. Wall portion 218 is discontinuous, providing stops 222, 224, 226 and 228 for cooperating with operating arms of different torsion spring configurations, as will be hereinafter described. Wall portion 192 also has a centrally disposed opening 230 defined by a surface 231 which functions as a first bearing support for arbor 178. A plurality of recesses, such as recess 232, may be spaced about the bearing surface 231 to provide space for foreign matter to be ejected from the mating bearing surfaces.

Back portion 190 includes a centrally disposed opening 234 defined by a bearing surface 236 which functions as a second bearing support for arbor 178. Recess 238 in bearing surface 236 functions the same as recess 232. Back portion 190 further includes a slot 237 for receiving a tab of the housing lid 176, as will be hereinafter explained.

The internal surface 239 of the right hand side wall 188 of housing base 174 includes a plurality of upstanding projections or posts 240, 242, 244, 248 and 250, which extend for a predetermined dimension into contact compartment 194, for purposes which will be hereinafter explained. The internal surface 239 of the right hand side wall 188 further includes contact element receiving and locating pads or stops which project outwardly from internal surface 239, such as contact receving pads 252, 254, 256, 258, 260 and 262. Each contact receiving pad includes openings for receiving terminal elements of the contact sets, such as openings 264 and 266 through contact receiving pads 260 and 262, respectively. The internal surface 239 of the right hand wall 188 additionally includes round depressions for receiving helical contact biasing springs, as will be hereinafter explained, such as depressions 268, 270 and 272.

Figure 31:
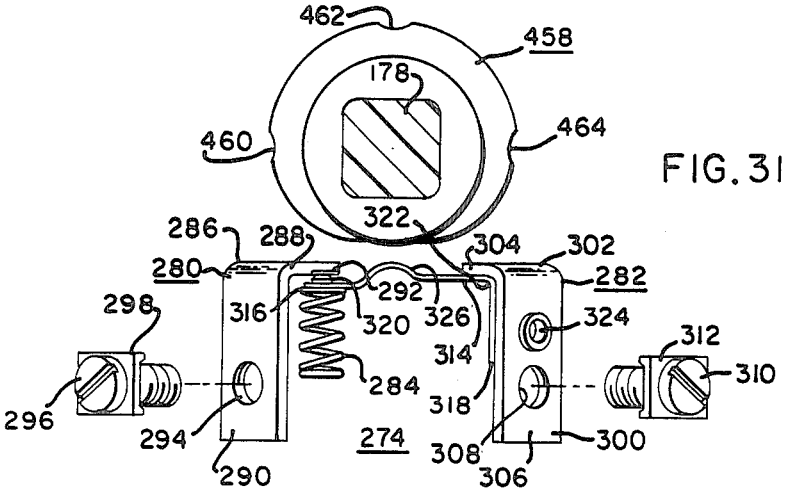
FIG. 31 is an elevational view of a contact set, illustrating the fixed and movable elements thereof, the biasing means for the movable element, and the position of the normally closed contact set relative to a cam.

The housing base 174 has provisions for receiving up to and including three contact sets, with two contact sets 274 and 276 being shown in FIGS. 12 and 13, and a third contact set 278 being shown in FIG. 9. If additional contact sets are desired, they are disposed in the housing lid 176, as will be hereinafter explained. Since the contact sets are identical, only contact set 274 will be described in detail. FIG. 31 will also be referred to while describing contact set 274, which Figure illustrates contact set 274 without the surrounding base structure.

More specifically, contact set 274 includes a stationary contact element 280, a movable contact element 282, and a helical biasing spring 284. The stationary contact element 280 is formed from an elongated strip of metal having a good electrical conductivity, such as OFHC copper. The elongated strip is bent at an angle of 45 degrees intermediate its ends, along bend 286, to provide contact portion 288 and a wire receiving terminal portion 290. The surface of contact portion 288 which will make electrical contact with the movable contact element 282 has a silver lamination 292 in the area of contact. Silver adheres readily to OFHC copper. The wire receiving terminal portion 290 includes a tapped opening 294 for receiving a screw 296 and an associated clamp member 298.

The movable contact element 282 includes a stationary portion 300 which may be the same design configuration as the stationary contact 280. In other words, it is formed from a strip of electrical conductor and bent at an angle of 45 degrees intermediate its ends, along a bend line 302 to form a movable contact holding portion 304 and a wire receiving terminal portion 306. Wire receiving terminal portion 306 includes a tapped opening 308 for receiving a screw 310 and an associated clamp member 312. While stationary portion 300 has the same design configuration as stationary contact element 280, it may be formed of electrolytic tough pitch (ETP) copper, since it does not have to be compatible with a silver lamination.

Movable contact element 282 further includes a resilient, bendable leaf spring contact arm portion 314 which is formed from a good electrical conductor having the requisite spring characteristic. For example, a 12% nickel-silver stamping having a thickness dimension of 0.008 inch may be used. Contact arm portion 314 has first and second ends 316 and 318, respectively, with a silver contact 320 being staked near the first end 316. Silver contact 320 has portions disposed on both sides of contact arm portion 314, with a portion on one side functioning as an electrical contact, and with the portion on the other side functioning as a spring seat for seating one end of a helical biasing spring. Contact arm portion 314 is bent at an angle of 45 degrees at bend point 322 to provide a bend which conforms to bend 302 in the stationary portion 300. The portion of contact arm 314 located between bend 322 and the second end 318 is riveted to portion 300, such as via a rivet 324. Contact arm portion 314 has a curved, U-shaped bend 326 for making contact with the lobes of a cam member, as will be hereinafter explained.

In assembling contact set 274 with the housing base 174, the helical coil spring 284 is dropped into the spring seat defined by depression 268, and the movable contact element has its wire receiving terminal end 306 inserted through wall portion 188, through an opening in pad 254 which is similar to the opening shown through pad 266. It is important to note that the contact element is inserted through the opening from the inside of the housing base, via compartment 194. A post on the housing lid 176 will subsequently force the movable contact element 282 against pad 254, and hold it in this position, as will be hereinafter explained, with this action occurring during the method of assembling the housing lid 176 with the housing base 174. The stationary contact element 280 has its wire terminal receiving end 290 inserted through an opening in pad 252, similar to the opening 264 shown in pad 260, again from the compartment 194 or internal side 239 of wall portion 188. A post on the housing lid 176 will subsequently positively seat and locate the stationary contact element 280 against pad 252. The screws 296 and 310 along with their associated wire clamps 298 and 312, respectively, are then threadably engaged with the tapped openings 294 and 308.

The external side 328 of wall portion 188 is provided with integral, upstanding barrier members which separate the wire receiving terminal portions of different contact sets. As hereinbefore stated, the planar wire receiving surfaces of the wire receiving terminal portions of the contact sets are oriented at an angle of 45 degrees with respect to the longitudinal centerline or rotational axis 76 of the key switch 40. The barrier members have planar surfaces oriented 45 degrees with the longitudinal axis 76, and 90 degrees with respect to the planar surfaces of the wire receiving contact terminals. For example, the stationary terminals of contact sets 274, 276 and 278 visible in FIG. 9 are separated by barriers 330 and 332. Barrier members 330 and 332 are also shown in FIG. 13. Similar barrier members along the opposite edge of wall portion 188 separate the wire receiving terminal portions of the movable contact elements of contact sets 274, 276 and 278. It will be noted that the 45 degree orientation of the wire receiving terminals makes it easy to attach wires to all six terminals of the three contact sets from the rear of the housing base. The separating barrier members aid in preventing shorting the wire receiving terminals of two adjacent contact sets by a screwdriver.

The housing lid 176 functions to close the housing base 174, it functions to apply locating and positioning pressures to the contact elements of the contact sets carried by the housing base 174, and it carries up to and including three additional contact sets, when key switch 40 requires more than three contact sets.

Figure 15:
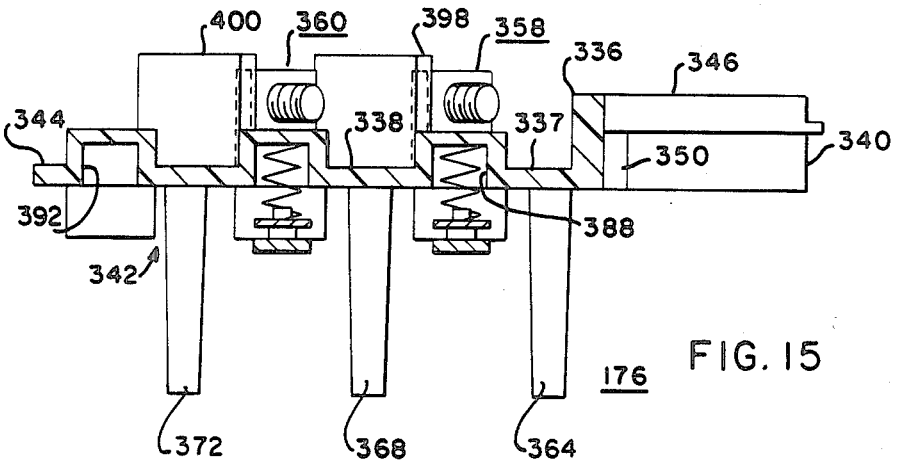
FIG. 15 is a cross-sectional view of the housing lid shown in FIG. 14, taken between and in the direction of arrows XV—XV.
Figure 14:
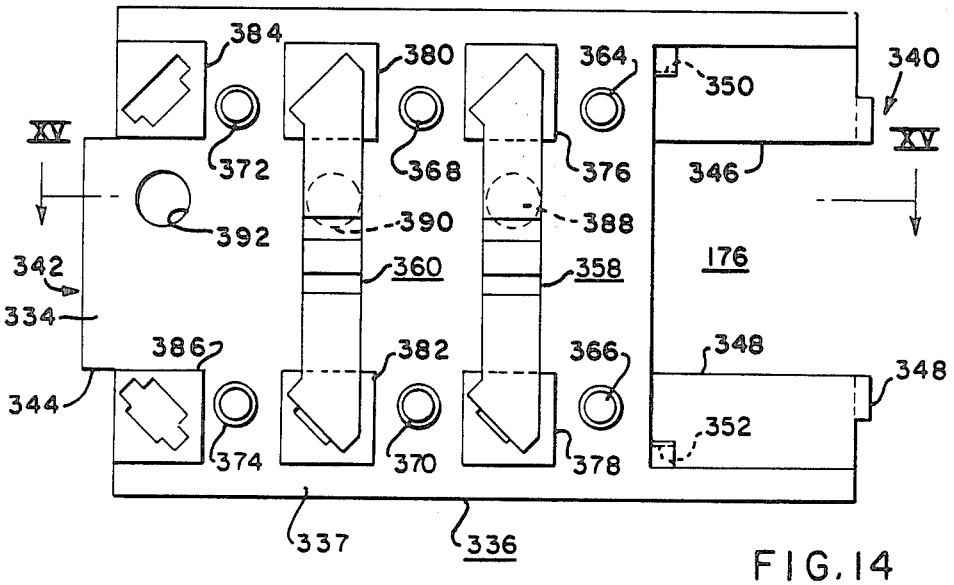
FIG. 14 is an elevational view of a housing lid portion of the contact housing shown in FIG. 9, illustrating two of three possible contact sets.

Housing lid 176, which is shown in perspective in FIG. 9, is also shown in FIGS. 14 and 15. FIG. 14 is an elevational view of the internal surface 334 of housing lid 176, illustrating two of the possible three contact sets, and FIG. 15 is a cross-sectional view of housing lid 176 taken between and in the direction of arrows XV—XV in FIG. 14.

More specifically, housing lid 176 includes a support structure 336 formed of a high strength plastic, such as a polycarbonate, having a wall portion 337 which defines the inner surface 334 hereinbefore referred to, an external surface 338, and first and second ends 340 and 342. The internal and external surfaces 334 and 338, respectively, are inside and outside housing 174, when the housing lid 176 is assembled with the housing base 174. The second end 342 includes a tab 344 which extends into the slot 237 in the back portion 190 of the housing base 174. The first end 340 is bifurcated, having spaced extensions or arms 346 and 348 which smoothly continue the mini-left hand side portion 212 of the housing base 174. Housing lid 176 includes small depressions or grooves 350 and 352 which cooperate with raised beads 354 and 356 on the housing base 174, to cause the housing lid 176 to mate with the housing base 174 with a snap action to firmly hold the two housing parts in assembled relation.

As shown in FIG. 9, housing lid 176 may be provided with up to and including three contact sets 358, 360 and 362. Contact set 362 is not shown in FIGS. 14 and 15 in order to more clearly illustrate the contact element receiving pads and wall openings therethrough. The internal surface 334 is substantially the same as the internal surface 239 of the right hand side 188 of the housing base 174. The only major difference is the fact that the positions of the contact sets carried by the housing lid 176 are located such that they alternate with the contact sets of the housing base 174, spaced along the rotational axis 76 of key switch 40, when the housing lid 176 is assembled with the housing base 174. The contact sets carried by the housing lid 176 are identical to those carried by the housing base 174, and thus they will not be described in detail.

It is sufficient to point out that surface 239 includes upstanding projections or posts 364, 366, 368, 370, 372 and 374, contact element receiving pads 376, 378, 380, 382, 384 and 386, and spring seats 388, 390 and 392.

The external side or surface 338 of housing lid 176 is also similar to the external side 328 of the housing base 174, having integral, upstanding barrier members 394, 396, 398 and 400 located to separate the wire receiving terminal portions of the different contact sets 358, 360 and 362. Similar to the wire receiving portions of the contact sets associated with the housing base 174, the wire receiving terminal portions of the contact sets carried by the housing lid 176 are oriented at an angle of 45 degrees from the horizontal in order to facilitate wire connection and disconnection from the rear of the key switch 40, not withstanding that a plurality of such switches, and other control elements, may be mounted closely adjacent to key switch 40.

Figure 17:
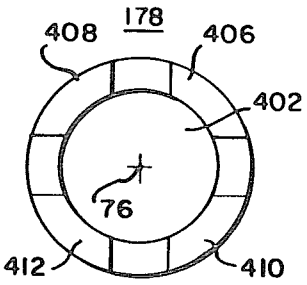
FIG. 17 is a right-hand end view of the arbor shown in FIG. 16, illustrating the toothed end which engages the teeth of the cam drive gear shown in FIGS. 6, 7 and 8.
Figure 16:
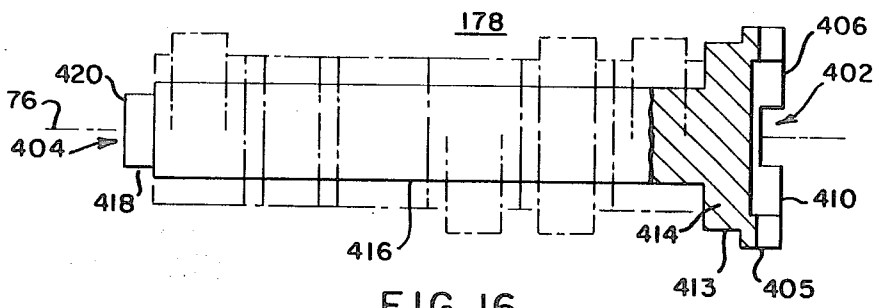
FIG. 16 is a side elevational view of the cam adapter shaft or arbor shown in perspective in FIG. 9, with the six possible cams being shown in phantom.
Figure 18:
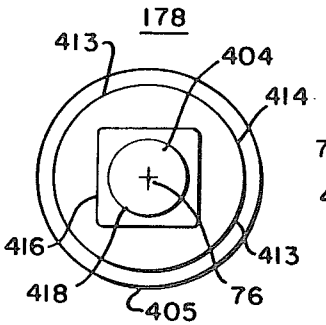
FIG. 18 is a left-hand end view of the arbor shown in FIG. 16, without any cams.

The cam adapter shaft or arbor 178, which is shown in perspective in FIG. 9, is also shown in FIGS. 16, 17 and 18. FIG. 16 is a side elevational view, partially in section, of arbor 178, with the six cam locations being shown in phantom. FIGS. 17 and 18 are right hand and left hand end views, respectively, of arbor 178, with respect to the orientation of arbor 178 shown in FIG. 16.

Arbor 178 is an elongated shaft formed of a high strength plastic, such as a polycarbonate formulated for good surface lubricity, to aid in the bearing functions it must provide. Arbor 178 has first and second axial ends 402 and 404, respectively, with the first axial end having a first cylindrical portion 405 which includes a plurality of axially extending teeth 406, 408, 410 and 412 which are circumferentially spaced about rotational axis 76. Teeth 406, 408, 410 and 412 are dimensioned to engage the teeth 156, 158, 160 and 162 of the cam drive gear member 114, as best shown in FIGS. 6, 7 and 8.

The diameter of the first cylindrical portion 405 of arbor 178 steps inwardly, after proceeding a short axial dimension from the base of the axially extending teeth, to a slightly smaller second cylindrical portion 413 having a diameter defined by a surface 414. Surface 414 functions as a first bearing surface of arbor 178, with the associated diameter of this bearing surface being selected for a smooth rotational fit with the diameter defined by the bearing surface 231 of housing base 174. The second cylindrical portion 413 then steps inwardly to a portion 416 which has a square cross-sectional configuration, with portion 416 being the cam-receiving portion of arbor 178. Portion 416 continues until reaching a small dimension from the second axial end 404, where it steps inwardly to a third cylindrical portion 418 having a surface 420 which functions as a second bearing surface of arbor 178. The diameter associated with bearing surface 420 is selected for a smooth, rotational fit with the diameter defined by the bearing surface 236 located in the back portion 190 of the housing base 174.

FIGS. 19 through 26 illustrate four cam configurations which may be used in any desired combination and orientation about rotational axis 76 on arbor 178, to achieve the desired contact configurations of each contact set at each position of the key switch. As hereinbefore stated, key switch 40 may have two, three or four positions, determined by stop washers 112'', 112', and 112, respectively, and in a preferred embodiment of the invention, key switch 40 may have any number of contact sets up to and including six. When less than six contact sets are utilized, the cam positions on arbor 178 situated adjacent to a missing contact set are simply filled with a spacer member. The cams shown in FIGS. 19 through 26 are constructed of a plastic selected for its ability to maintain its dimensions and mechanical strength at elevated temperatures. For example, a polyetheremide resin, such as General Electric's Ultem 1000, is suitable.

Figure 19:
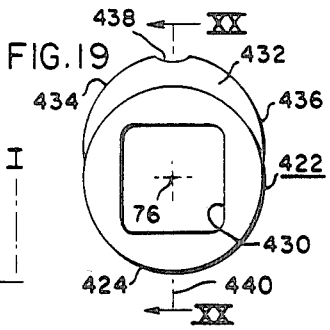
FIG. 19 is an end view of a cam which may be slipped into position on the arbor shown in FIG. 16, illustrating a single cam lobe embodiment.
Figure 20:
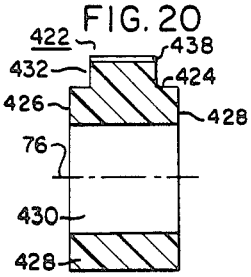
FIG. 20 is a cross-sectional view of the cam shown in FIG. 19, taken between and in the direction of arrows XX—XX.

FIGS. 19 and 20 illustrate a first cam 422 which may be used. FIG. 19 is an elevational view of one axial end of cam 422, and FIG. 20 is a cross-sectional view of cam 422 taken between and in the direction of arrows XX—XX in FIG. 19. Cam 422 includes a cylindrical portion 424 having first and second axial ends 426 and 428, and a square opening 430 which extends between its axial ends. Opening 430 is dimensioned to provide a snug, sliding fit with the square shaft portion 416 of arbor 178. The dimension between axial ends 426 and 428 is one-sixth the axial dimension of the square shaft portion 416. Cam 422 includes a single cam lobe 432 which smoothly rises from the cylindrical portion 424 along curved portions 434 and 436, until reaching a peak dimension from rotational axis 76 selected to open and provide the desired spacing between the stationary and movable contact elements of a contact set. The high point of the cam lobe 432 has a groove 438 having a configuration complementary to the curved portion 326 of the movable contact leaf spring portion 314, to provide tactile feedback to the user at a switch position of the key switch 40.

Figure 27:
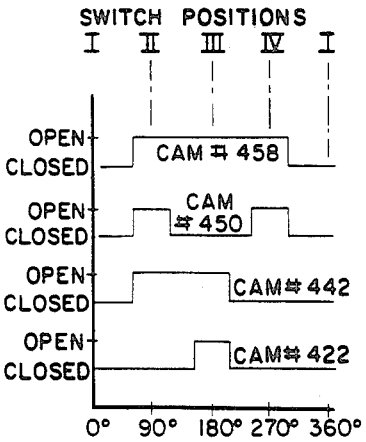
FIG. 27 is a graph which illustrates the operative affect of the four different cams shown in FIGS. 19 through 26 on normally closed contact sets, through 360°-degree rotation of the arbor shown in FIG. 16, with the cams being oriented as illustrated in the Figures, in the 0-degree position of the graph.

Cam 422 may be used with two-, three-, and four-position switches, with FIG. 27 being a graph which illustrates the action of cam 422 on a contact set. If point 440 on cam 422 is facing a contact set at the 0 degree location on the graph shown in FIG. 27, e.g., position I of key switch 40, then cam 422 will open the associated contact set at the switch location corresponding to a rotational movement of 180 degrees, i.e., switch position III.

Since the remaining cams are similar in construction to cam 422, except for the number and location of cam lobes, only the differences will be described relative to FIGS. 21 through 26.

Figure 21:
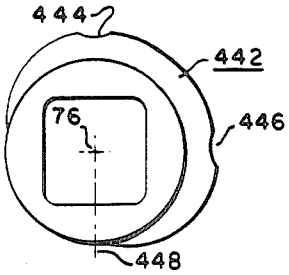
FIG. 21 is an end view of another cam which may be telescoped over the arbor shown in FIG. 16, illustrating an embodiment having two adjacent cam lobes.
Figure 22:
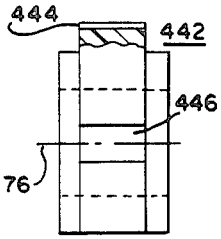
FIG. 22 is a side elevational view, partially in section, of the cam shown in FIG. 21.

More specifically, FIGS. 21 and 22 illustrate a cam 442 having two adjacent cam lobes 444 and 446. FIG. 21 is an elevational view of one axial end of cam 442, and FIG. 22 is a side elevational view, partially in section. Cam 442 may be used with three- and four- position key switches. If point 448 on cam 442 is adjacent to a contact set at the 0 degree position on the graph of FIG. 27, cam 442 will open the associated contact set at switch positions II and III.

Figure 23:
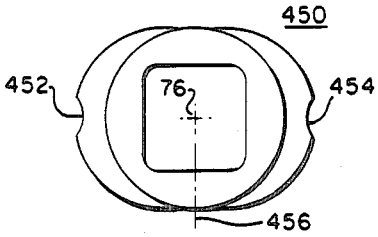
FIG. 23 is an end view of still another cam which may be used with the arbor shown in FIG. 16, illustrating an embodiment having two spaced cam lobes.
Figure 24:
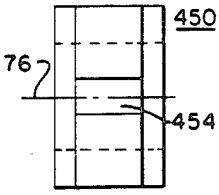
FIG. 24 is a side elevational view of the cam shown in FIG. 23.

FIGS. 23 and 24 illustrate a cam 450 having two spaced cam lobes 452 and 454. FIG. 23 is an elevational view of one axial end of cam 450, and FIG. 24 is a side elevational view. Cam 450 may be used with three- and four-position switches. If point 456 is adjacent to a contact set at the 0 degree position on the graph of FIG. 27, cam 450 will open the associated contact set at switch positions II and IV.

Figure 25:
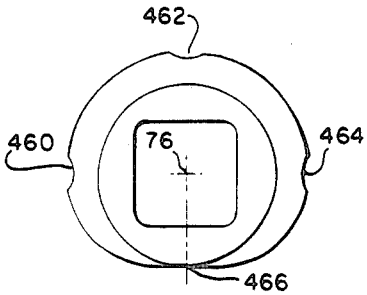
FIG. 25 is an end view of another cam which may be used, illustrating a three-cam lobe embodiment.
Figure 26:
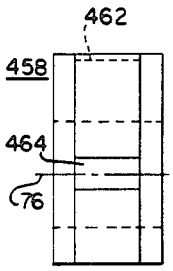
FIG. 26 is a side view, partially in section, of the cam shown in FIG. 25.

FIGS. 25 and 26 illustrate a cam 458 having three adjacent cam lobes 460, 462 and 464. FIG. 25 is an elevational view of one axial end of cam 458, and FIG. 26 is a side elevational view, shown partially in section. Cam 458 may be used with a four-position switch. If point 466 of cam 458 is adjacent to a contact set at the 0 degree position on the graph of FIG. 27, cam 458 will open the associated contact set at switch positions II, III, and IV.

Figure 28:
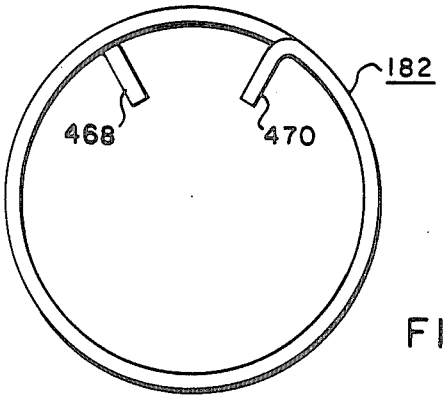
FIG. 28 is an elevational end view of a torsion spring which may be used to provide a momentary contact switch embodiment of the invention.
Figure 29:
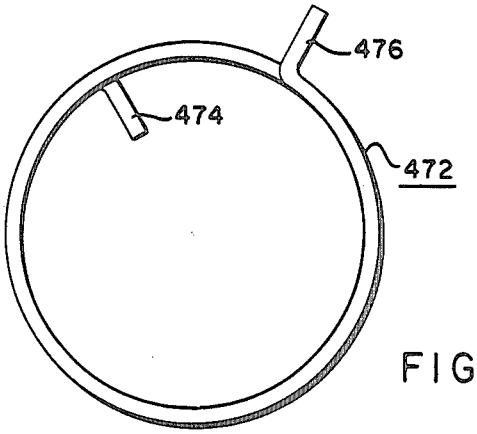
FIG. 29 is an elevational end view of still another torsion spring which may be used to provide a momentary contact key switch.
Figure 30:
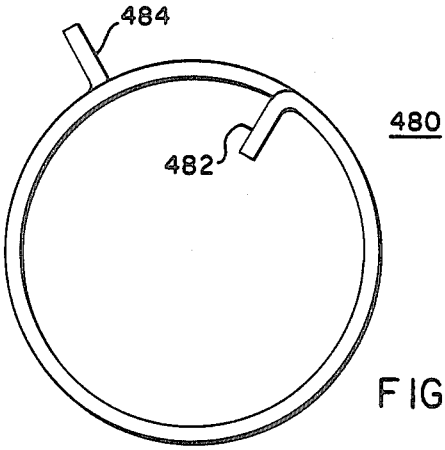
FIG. 30 is an elevational end view of another torsion spring which may be used to provide a momentary contact key switch.

FIGS. 28, 29 and 30 are axial end views of torsion springs which may be used to convert key switch 40 into a momentary contact switch. FIG. 28 illustrates the torsion spring 182 shown in perspective in FIG. 9. Torsion spring 182 has a plurality of turns, such as four, and is dimensioned to fit into the space 220, best shown in FIG. 10, located between curved portions 216 and 218 of housing base 174. Spring 182 has both ends turned inwardly. Spring 182 is assembled under tension such that spring ends 468 and 470 overlap, with spring end 470 resting against stop 228 and spring end 468 resting against stop 224, which stops are shown in FIG. 10. Driving key 168 of cam drive gear member 114 is disposed between spring ends 468 and 470. In the clockwise turning direction of the cam drive gear member 114, the driving key 168 will engage spring end 468 and drive it to stop 222 while storing energy in the spring. Releasing the key 128 allows the torsion spring to return the switch to the switch position before the switch position at which the momentary contact was made. In like manner, counterclockwise rotation of member 114 causes driving key 168 to engage spring end 470 and drive it to stop 226, while storing energy in the spring.

FIG. 29 illustrates a torsion spring 472 which has an inwardly turned end 474 and an outwardly turned end 476. Spring 472 is assembled under tension, with the outwardly turned end 476 fitting into slot 478 located in curved portion 216, as shown in FIG. 10, and with the inwardly turned end 474 resting against stop 224 in curved portion 218. Spring 472 functions when drive key 168 contacts spring end 474 during clockwise rotation, driving spring end 474 to stop 222 while storing energy in the torsion spring. Momentary contact is made at a switch position when spring end 474 reaches stop 222, and release of the key 128 will cause the spring to return the switch to the switch position it occupied before reaching the momentary contact switch position.

FIG. 30 illustrates a torsion spring 480 which functions similar to torsion spring 472, except for counterclockwise rotation of the key switch 40. Spring 480 includes an inwardly turned end 482 and an outwardly turned end 484. Spring 480 is assembled under tension, with the outwardly turned end 484 fitting into slot 478 of the housing base 174, and with the inwardly turned end 482 resting against stop 228. Spring 480 functions when drive key 168 contacts spring end 482 during counterclockwise rotation, driving spring end 482 to stop 226 while storing energy in the spring. Momentary contact is made at a switch position when spring end 482 reaches stop 226, and release of the key 128 will cause the stored energy in the spring to return the switch to the switch position it occupied before reaching the momentary contact position.

The assembly of key switch 40, as well as a new and improved method of constructing a key switch according to the invention, will now be described relative to FIG. 9. As hereinbefore stated, the housing base 174 includes up to and including three contact sets 274, 276 and 278 which are axially spaced along an internal wall 239, with the wire receiving terminal ends of the contact sets being inserted through wall openings from the inside of the wall to the outside of the wall. In like manner, the wire receiving terminal ends of the contact sets 358, 360 and 362 associated with the housing lid 176 are inserted through wall openings, from the internal side or surface 334, to the outer side or surface. To ensure that the two elements of each contact set are precisely in position against their associated locating pads at all times, projections or posts are provided on the same internal walls of the housing lid and base which carry the contact sets, with these posts being positioned and dimensioned such that when the housing lid and base are assembled in a direction substantially perpendicular to the longitudinal rotational axis 76 of the key switch 40, the posts will force the contact elements against their associated stops and continuously hold them in this position. Thus, it is assured that the contact sets are always in the proper position relative to the cams on the arbor 178. More specifically, arbor 178, with the cams in position, is inserted into the housing base 174 until bearing surface 420 of arbor 178 is resting against bearing surface 236 of the housing base 174, and bearing surface 414 of arbor 178 is resting against bearing surface 231 of the housing base 174. The housing lid 176 is then placed alongside of the housing 174, approximately in the assembled configuration, and tab 344 of the housing lid 176 is inserted into slot 237 of the housing base 174. Then, with a pivotal movement, the housing lid is pivoted towards the housing base and snapped into position, with beads 354 and 356 of the housing base 174 engaging grooves 350 and 352 of the housing lid 176, to firmly hold the housing lid in assembled relation with the housing base. As the housing lid 176 snaps into the desired position on the housing base 174, posts 366, 370 and 374 of the housing lid 176 rest against the stationary elements of contact sets 274, 276 and 278, respectively, posts 364, 368 and 372 of the housing lid rest against the stationary portions of the movable elements of contact sets 274, 276 and 278, posts 242, 246 and 250 of the housing base 174 rest against the stationary portions of the movable elements of contact sets 358, 360 and 362, respectively, and posts 240, 244 and 248 of the housing base rest against the stationary elements of contact sets 358, 360 and 362.

Figure 32:
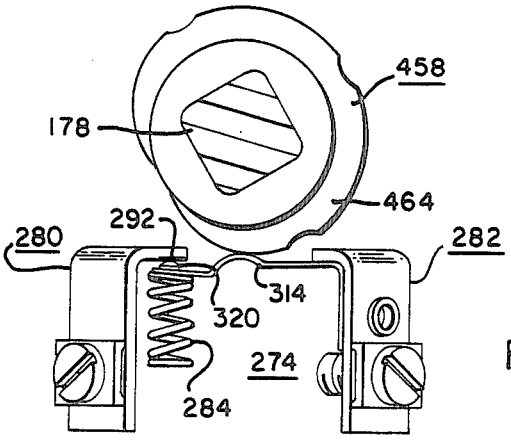
FIG. 32 illustrates a contact wiping action which occurs when the normally closed contact set is actuated by a cam, due to the relative strengths of the helical contact biasing spring and a leaf spring associated with the movable contact.
Figure 33:
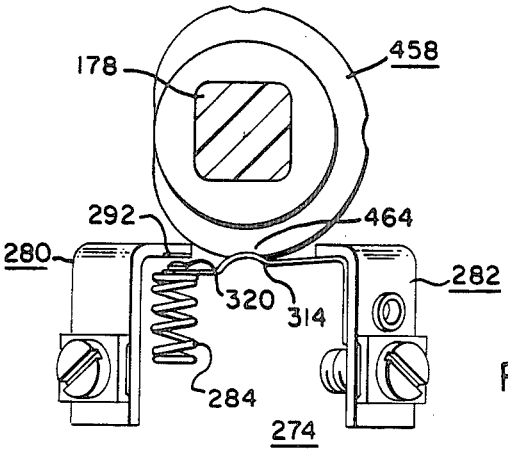
FIG. 33 illustrates the contact set of FIGS. 31 and 32, with the contact set being fully actuated to an open contact configuration by a cam.

It is important to note that the leaf spring portion 314 of the movable contact element 282 of a contact set is deliberately selected to be weaker than the helical biasing spring 284. In other words, the spring constant of the leaf spring is less than the spring constant of the helical spring. This provides a contact wiping action each time the elements of a contact set engage, and each time they break. FIGS. 31, 32 and 33 illustrate a step-by-step actuation of contact set 274 from its normally closed configuration to an open configuration, utilizing cam 458 shown in FIGS. 25 and 26. FIG. 31 illustrates cam 458 in switch position 1. FIG. 32 illustrates cam 458 after clockwise rotation of arbor 178 to a point intermediate switch positions I and II. It will be noted that the weaker leaf spring 314 has deflected more than the stronger coil spring 284, causing silver contact element 320 to slide and rock on the silver contact lamination 292. Continued clockwise movement of cam 458 to the high point of cam lobe 364 compresses helical spring 284 to a point which provides the desired separation of silver contacts 292 and 320. If cam 458 were now to be rotated counterclockwise, the silver contacts 320 would again rock and slide on the silver lamination 292 as the contact 320 initially engages the silver lamination 292, as shown in FIG. 32.

In summary, there has been disclosed an improved multi-contact, multi-position key switch, as well as a new and improved method of assembling same. The new key switch is modular in construction, easily permitting any desired sequence of closed and open contacts from contact set to contact set, at each position of the key switch. The ease in assembly to customer order specifications exists not only at the time of original assembly, but also subsequent thereto, easily permitting new open and closed switch sequences to be subsequently selected by using the proper cams, and orientation thereof, on the supporting arbor. A new halo may be snapped into position, if desired, if subsequent changes to the key switch require modification of the original legends.

I claim as my invention:

1. A key switch of modular construction, comprising:
a halo module,
a lock module mounted in said halo module,
an electrical contact module,
said lock and halo modules being assembled with said electrical contact module on a common longitudinal axis,
said electrical contact module including a housing having first and second separable housing members which define axial ends and internal and external sides of said housing,
means mechanically interlocking said first and second housing members at one axial end of the housing with said means including a tab on one housing member and a slot in the other housing member, said tab and slot cooperatively forming a pivotable joint which is operative during assembly and disassembly of said first and second housing members,
means frictionally interlocking said first and second housing members at the remaining axial end of the housing,
said halo module maintaining said first and second housing members in assembled relation at said frictionally interlocked end, a first contact set carried by said first housing member, said first contact set including stationary and actuatable contact elements with said stationary and actuatable contact elements each having a rigid electrically conductive member which extends from the internal to the external sides of said housing, an arbor mounted for rotation in said housing, on said common longitudinal axis, with said arbor being actuatable by said lock module, a first cam member on said arbor for actuating said first contact set, and posts on said second housing member which hold said rigid electrically conductive members against the internal side of said housing and prevent said rigid electrically conductive members from moving in a direction from the external to the internal sides of said housing.

2. The key switch of claim 1 including positioning stops on the internal side of the first housing member, with the posts on the second housing member holding the rigid electrically conductive members of the first contact set against said positioning stops.

3. The key switch of claim 1 including:

a plurality of contact sets, similar to the first contact set, said plurality of contact sets being carried by both the first and second housing members in alternating positions along the common longitudinal axis, a plurality of cam members removably positioned on the arbor in axially spaced relation, for actuating said plurality of contact sets, and posts on both the first and second housing members which maintain the the rigid electrically conductive members of the plurality of contact sets in the desired positions.

4. The key switch of claim 1 including a second contact set carried by said first housing member, which is similar to the first contact set but spaced therefrom along the longitudinal axis, the contact elements of the first and second contact sets including wire receiving portions disposed adjacent to a predetermined external side of the housing, with the wire receiving portions having flat planar surfaces oriented about 45 degrees relative to the longitudinal axis, and including insulative barrier members on said predetermined external side of the housing, between adjacent wire receiving elements of the first and second contact sets, with the insulative barrier members having planar surfaces oriented perpendicular to the planar surfaces of the separated wire receiving elements.

5. The key switch of claim 1 wherein the arbor has first and second axial ends, with the first axial end having a plurality of teeth, and the lock module includes a first end for receiving a key, and a second end having teeth for engaging the teeth of the arbor.

6. A key switch of modular construction, comprising;

a halo module, a lock module mounted in said halo module, an electrical contact module, said lock and halo modules being assembled with said electrical contact module on a common longitudinal axis, said electrical contact module including a housing having first and second pivotably separable and closable housing members which define axial ends and internal and external sides of said housing, with said first and second housing members being mechanically interlocked at one axial end, and frictionally interlocked at the remaining axial end, and wherein said halo module mechanically interlocks the first and second housing members at the frictionally interlocked end, a predetermined number of contact sets carried by each of said first and second housing members, with said contact sets of the first and second housing members alternating with one another along the common longitudinal axis, each of said contact sets including stationary and actuatable contact elements with each of said stationary and actuatable contact elements having rigid electrically conductive members which extend from the internal to the external sides of said housing, an arbor mounted for rotation in said housing on said common longitudinal axis, with said arbor being actuatable by said lock module, removable cam members axially spaced on said arbor in a selected one of a plurality of orientations about the common longitudinal axis, for actuating said contact sets at predetermined rotary positions of said arbor, and posts on each of said first and second housing members which maintain the rigid electrically conductive members of the contact elements carried by the other housing member in the desired operating positions, with the posts from the first and second housing members alternating with one another in first and second rows on opposite sides of said arbor.

* * * * *